US010302308B2

(12) United States Patent
Peng

(10) Patent No.: US 10,302,308 B2
(45) Date of Patent: May 28, 2019

(54) KITCHEN HOOD WITH HIDDEN SWITCH BOX

(71) Applicant: Ta-Chun Peng, Taichung (TW)

(72) Inventor: Ta-Chun Peng, Taichung (TW)

( * ) Notice: Subject to any disclaimer, the term of this patent is extended or adjusted under 35 U.S.C. 154(b) by 162 days.

(21) Appl. No.: 15/456,583

(22) Filed: Mar. 13, 2017

(65) Prior Publication Data

US 2018/0259195 A1 Sep. 13, 2018

(51) Int. Cl.
*F24C 15/20* (2006.01)

(52) U.S. Cl.
CPC ..... *F24C 15/2021* (2013.01); *F24C 15/20* (2013.01); *F24C 15/2042* (2013.01)

(58) Field of Classification Search
CPC ... F24C 15/2042; F24C 15/2021; F24C 15/20
See application file for complete search history.

(56) References Cited

U.S. PATENT DOCUMENTS 3,233,606 A * 2/1966 Turner ..... B24B 31/14 126/299 D
3,785,124 A * 1/1974 Gaylord ..... F24C 15/2057 126/299 D
3,834,295 A * 9/1974 Seidel ..... F24C 15/2021 126/299 D
4,327,274 A * 4/1982 White ..... F24C 15/2042 126/198
4,972,296 A * 11/1990 Chu ..... H01R 13/631 211/41.17
5,189,597 A * 2/1993 Mayer ..... H02B 1/36 312/323
6,072,169 A * 6/2000 Kang ..... F24C 15/2042 126/273 A
6,222,171 B1 * 4/2001 Fukuda ..... A47B 77/08 219/702
7,819,561 B2 * 10/2010 Puglisi ..... F21S 8/02 362/371
9,487,134 B2 * 11/2016 Munday ..... B60Q 3/44

FOREIGN PATENT DOCUMENTS

GB 2451936 A * 2/2009 ..... H02G 3/123

* cited by examiner

*Primary Examiner* — Michael C Zarroli

(57) ABSTRACT

A kitchen hood includes a casing and a room is defined in the casing. A window is defined in the casing and communicates with the room. A switch box is positioned in the room by a positioning module. The switch box has a switch cover to which multiple switches are connected. An activation module is connected to inside of the room and the switch box. The activation module controls the switch cover to be exposed from the window or hidden in the window.

7 Claims, 4 Drawing Sheets

KITCHEN HOOD WITH HIDDEN SWITCH BOX

BACKGROUND OF THE INVENTION

1. Fields of the Invention

The present invention relates to a kitchen hood, and more particularly, to a kitchen hood with a hidden switch box.

2. Descriptions of Related Art

The conventional kitchen hoods usually include a switch box exposed on a visible portion of the casing of the kitchen hood, so that the users are able to access the switch box easily. However, along with more demands of styling and fashion, the exposed switch box is not accepted by the users. In addition, the exposed switch box easily gets grease attached thereto and causes problems.

The present invention intends to provide a kitchen hood that includes a hidden switch box so as to eliminate the shortcomings mentioned above.

SUMMARY OF THE INVENTION

The present invention relates to a kitchen hood and includes a casing having a room defined therein, and a window is defined in the casing and communicates with the room. A switch box is positioned in the room by a positioning module. The switch box has a switch cover to which multiple switches are connected. An activation module is connected to inside of the room and the switch box. The activation module controls the switch cover to be exposed from the window or hidden in the window.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
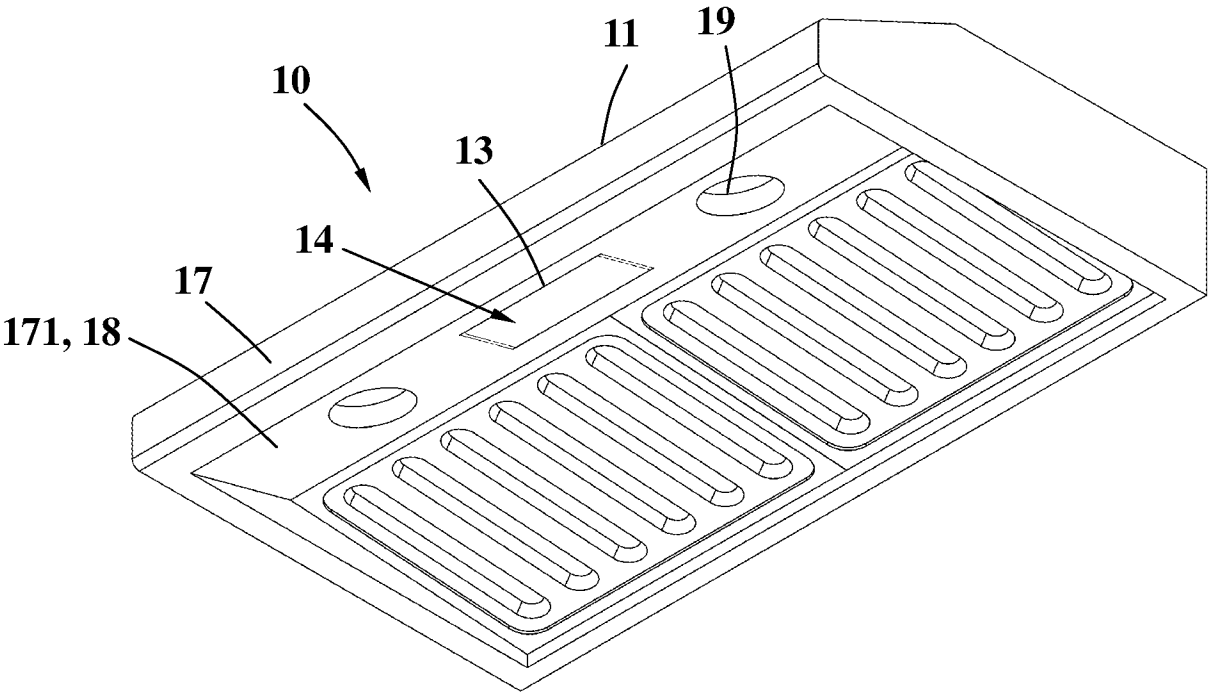
FIG. 1 is a perspective view to show the kitchen hood of the present invention, wherein the switch cover is hidden.
Figure 2:
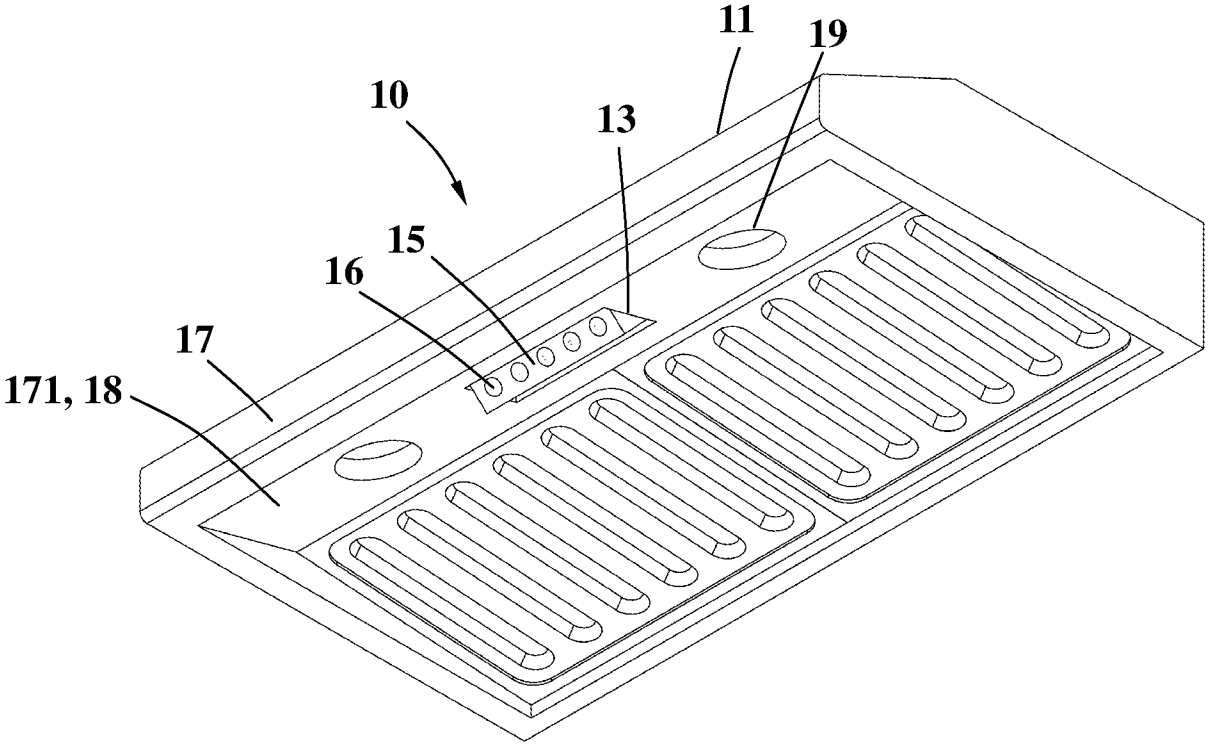
FIG. 2 is a perspective view to show the kitchen hood of the present invention, wherein the switch cover is exposed.

Referring to FIGS. 1 to 4, the kitchen hood 10 of the present invention comprises a casing 11 having a room 12 defined therein. A window 13 is defined in the casing 11 and communicates with the room 12. A switch box 14 is positioned in the room 12 by a positioning module 30. The switch box 14 has a switch cover 15, and multiple switches 16 are connected to the switch cover 15. The switches 16 are operated to activate functions of the kitchen hood 10. The switches 16 are membrane switches.

An activation module 20 is connected to inside of the room 12 and detachably connected with the switch box 14. The activation module 20 controls the switch cover 15 to be exposed from the window 13 or hidden in the window 13.

When the switch cover 15 is exposed, the users can easily access the switches 16 to control the kitchen hood 10. When the switch cover 15 is hidden in the window 13, the switch cover 15 cannot be seen from outside of the kitchen hood 10.

The window 13 is located at the middle portion, the right side or the left side of the casing 11. In this embodiment, the window 13 is located at the middle portion, the right side or the left side of the bottom face 171 of the front side 17 of the casing 11. Preferably, the window 13 is located at the light cover 18 of the casing 11 and located between two apertures 19 for lights.

Figure 3:
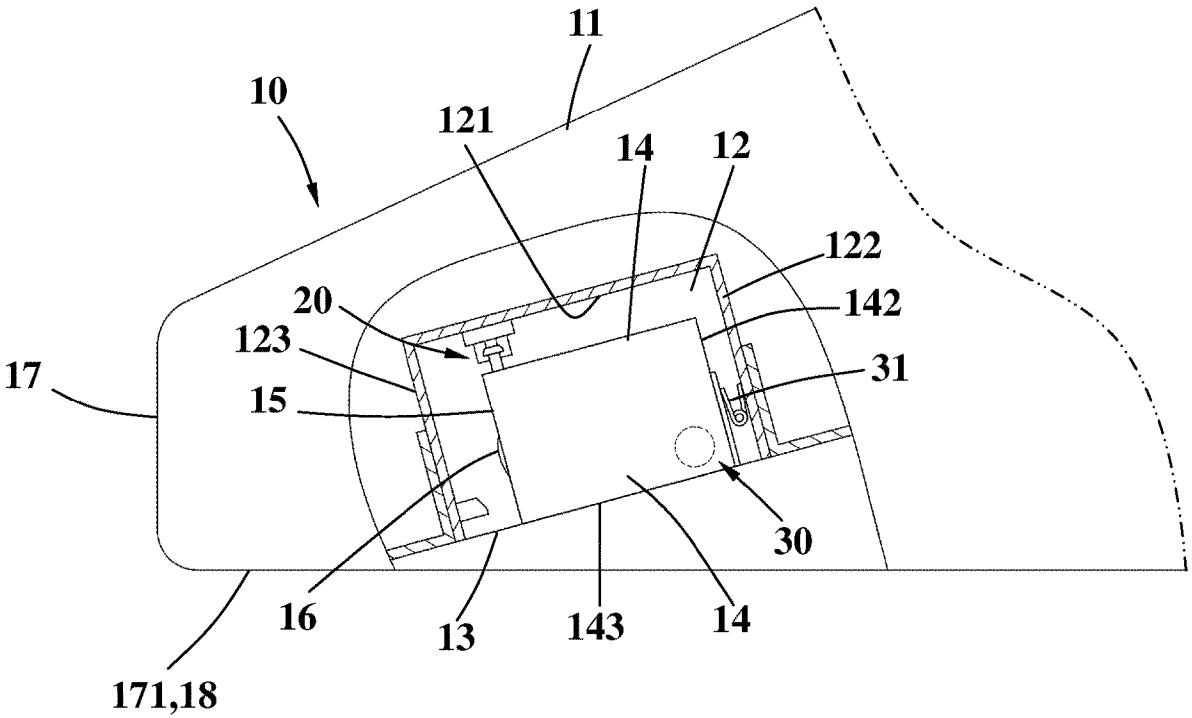
FIG. 3 is a cross sectional view of the kitchen hood of the present invention, wherein the switch cover is hidden.
Figure 4:
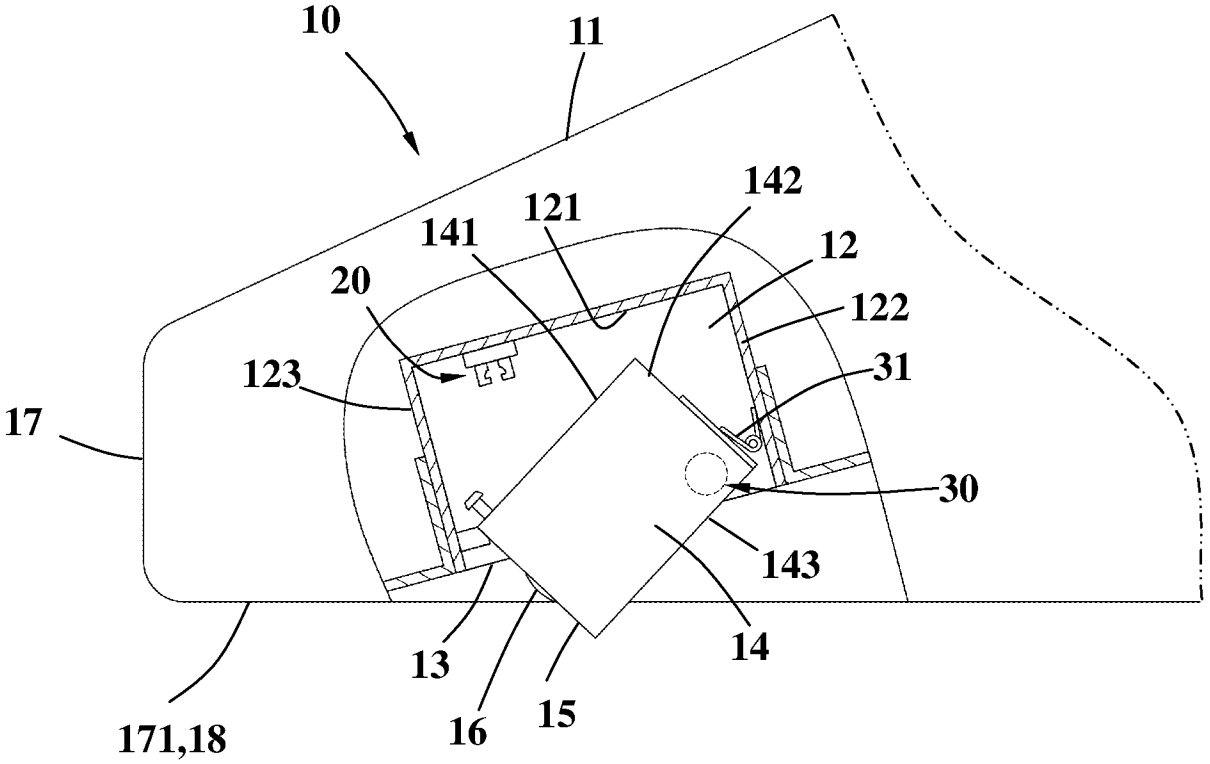
FIG. 4 is a cross sectional view of the kitchen hood of the present invention, wherein the switch cover is exposed.

As shown in FIGS. 3 and 4, the activation module 20 is a self-locking rebound device or the like. The activation module 20 ensures that the switch box 14 is stably received in the room 12.

The positioning module 30 is a pivot unit. The switch box 14 has one end thereof positioned in the room 12 by the pivot unit. The switch box 14 is controlled by the activation module 20 and pivots back and forth an angle about the pivot unit so as to expose or hide the switch cover 15 relative to the window 13. The activation module 20 is located between the top 141 of the switch box 14 and the inner wall 121 of the room 12. A spring 31 is located between the rear side 142 of the switch box 14 and the rear wall 122 of the room 12.

When the switch box 14 is locked in the room 12 by the activation module 20, the switch cover 15 faces the front wall 123 of the room 12. The bottom 143 of the switch box 14 faces the window 13. The user pushes the switch box 14 from the bottom, 143, the activation module 20 is activated and bounces to open, so that the switch box 44 is pivoted downward a pre-set angle about the positioning module 30 to expose the switch cover 15 from the window 13. When the use pushes the switch box 14 upward, the switch box 14 is pushed into the room 12, and the activation module 20 is activated again to lock the switch box 14 in the room 12. The spring 31 is compressed or released when the switch box 14 is pivoted, the spring 31 keeps the switch box 14 to be stably operated with shaking.

While we have shown and described the embodiment in accordance with the present invention, it should be clear to those skilled in the art that further embodiments may be made without departing from the scope of the present invention.

What is claimed is:

1. A kitchen hood comprising:

a casing having a room defined therein, a window defined in the casing and communicating with the room, the window located at a light cover of the casing;

a switch box positioned in the room by a positioning module, the switch box having a switch cover, multiple membrane switches are connected to the switch cover, and an activation module connected to inside of the room and detachably connected to the switch box, the activation module controlling the switch cover to be exposed from the window or hidden in the window.

2. The kitchen hood as claimed in claim 1, wherein the window is located at a middle portion, a right side or a left side of the casing.

3. The kitchen hood as claimed in claim 1, wherein the window is located at a middle portion, a right side or a left side of a bottom face of a front side of the casing.

4. The kitchen hood as claimed in claim 1, wherein the activation module has features of self-locking and rebound.

5. The kitchen hood as claimed in claim 1, wherein the positioning module is a pivot unit, the switch box has one end thereof positioned in the room by the pivot unit, the switch box is controlled by the activation module and pivots back and forth an angle about the pivot unit so as to expose or hide the switch cover relative to the window.

6. The kitchen hood as claimed in claim 5, wherein the activation module is located between a top of the switch box and an inner wall of the room, the activation module has features of self-locking and rebound, a spring is located between a rear side of the switch box and a rear wall of the room.

7. A kitchen hood comprising:

a casing having a room defined therein, a window defined in the casing and communicating with the room, the window located at a light cover of the casing;

a switch box positioned in the room by a positioning module, the switch box having a switch cover, multiple switches are connected to the switch cover, and an activation module connected to inside of the room and detachably connected to the switch box, the activation module located between a top of the switch box and an inner wall of the room, the activation module having features of self-locking and rebound, a spring is located between a rear side of the switch box and a rear wall of the room, the activation module controlling the switch cover to be exposed from the window or hidden in the window.

* * * * *